US008016111B2

(12) United States Patent
Wilson et al.

(10) Patent No.: US 8,016,111 B2
(45) Date of Patent: Sep. 13, 2011

(54) REUSABLE SHOPPING BAG ASSEMBLY

(75) Inventors: Monica Michele Wilson, Frontenac, KS (US); Erik Jay Batalia, Pittsburg, KS (US)

(73) Assignee: Elemental Muse, LLC, Frontenac, KS (US)

( * ) Notice: Subject to any disclaimer, the term of this patent is extended or adjusted under 35 U.S.C. 154(b) by 84 days.

(21) Appl. No.: 12/429,479

(22) Filed: Apr. 24, 2009

(65) Prior Publication Data

US 2009/0268990 A1 Oct. 29, 2009

Related U.S. Application Data

(60) Provisional application No. 61/071,445, filed on Apr. 28, 2008.

(51) Int. Cl.
*B65B 67/12* (2006.01)
*B65D 33/14* (2006.01)

(52) U.S. Cl. ..... 206/554; 206/806; 206/493

(58) Field of Classification Search ..... 206/554, 206/449, 806, 482, 493; 220/375; 211/50; 383/22, 13, 32, 6, 35; 248/95, 100, 101
See application file for complete search history.

(56) References Cited

U.S. PATENT DOCUMENTS

| | | | | |
|---|---|---|---|---|
| 3,044,233 | A * | 7/1962 | Altman, Jr. | 53/385.1 |
| 3,312,339 | A * | 4/1967 | Million | 206/493 |
| 3,352,411 | A * | 11/1967 | Schwarzkopf | 206/493 |
| 4,194,657 | A * | 3/1980 | Thor | 224/667 |
| 5,335,788 | A | 8/1994 | Beasley et al. | |
| 5,377,833 | A * | 1/1995 | Ranger | 206/430 |
| 5,419,437 | A * | 5/1995 | Huseman | 206/554 |
| 5,524,762 | A * | 6/1996 | Shafran et al. | 206/554 |
| 5,682,730 | A * | 11/1997 | Dobreski | 53/469 |
| 6,264,035 | B1 * | 7/2001 | Petrie | 206/554 |
| 6,374,577 | B1 * | 4/2002 | Ventura | 53/390 |
| 7,080,756 | B2 * | 7/2006 | Cunningham | 221/26 |

* cited by examiner

*Primary Examiner* — Steven A. Reynolds
(74) *Attorney, Agent, or Firm* — Lathrop & Gage LLP

(57) ABSTRACT

A reusable shopping bag assembly includes handle structure for use with a plurality of reusable shopping bags. The handle structure includes a handle frame with a pair of tubular sleeves extending therefrom in spaced relation to support a plurality of the reusable shopping bags having sleeve receiving holes therethrough and a pair of caps connected to the frame by cords and removably positioned on the sleeves the retain the bags thereon. The sleeves are spaced apart and bores therethrough are sized and shaped to enable the handle structure with a plurality of reusable shopping bags thereon to be positioned on a rack holding store bags to facilitate placement of merchandise in the reusable bags.

20 Claims, 3 Drawing Sheets

REUSABLE SHOPPING BAG ASSEMBLY

CROSS-REFERENCE TO RELATED APPLICATION

This application claims priority under 35 U.S.C. 119(e) and 37 C.F.R. 1.78(a)(4) based upon copending U.S. Provisional Application Ser. No. 61/071,445 for REUSABLE SHOPPING BAGS MADE EASY, filed Apr. 28, 2008, the disclosure of which is incorporated herein by reference.

FIELD OF THE INVENTION

The present invention is broadly concerned with packaging for purchased merchandise and, more particularly, to an assembly of reusable shopping bags.

BACKGROUND OF THE INVENTION

Packaging constitutes a substantial proportion of the cost of providing goods to customers in terms of the manufacture of packaging materials and packaging processes. Although paper bags and sacks were primarily used to package purchased merchandise in the past, currently various types of plastic bags are provided by most merchants. Plastic bags are provided to merchants in various ways, generally to make their use convenient at checkout stands to avoid delays to customers in line. In some cases, refillable racks or dispensers are provided on which groups of plastic bags are placed where they can be removed one at a time during checkout. One common type of rack includes a framework with a pair of horizontally extending rods or arms on which groups of plastic bags are placed, the bags having pairs of rod receiving apertures or a rounded slot for forming a convenient handhold. The rack allows a bag to be pulled open and supported in an open condition while being filled with purchased merchandise. When filled, the bag is removed from the rack and given to the customer or placed in a shopping cart. A refillable bag rack of this general nature is shown in U.S. Pat. No. 5,335,788, the disclosure of which is incorporated herein by reference.

In many cases, plastic bags are used a single time and then discarded as trash. There are movements to encourage shoppers to reuse plastic bags or to purchase and make use of reusable shopping bags. Reusable shopping bags are made of more durable materials than single-use plastic bags and may be formed of a heavier plastic film or of a sturdy woven fabric, such as of canvas, synthetic fibers, or the like. A single reusable shopping bag may be convenient to use when shopping for just a few items. However, shoppers are also encouraged to minimize shopping trips to reduce vehicle fuel usage. Thus, if a customer shops for a large number of items at one time, inconveniences can result from attempts to pack purchases into a multitude of reusable shopping bags. The reusable bags can be carried loosely or rolled or folded into one of the bags, as the customer shops. When the customer is ready to checkout, the bags must be given to the cashier or a sacker, thereby possibly cluttering the counter. Otherwise, if the customer places the checked-out items in the bags, delays can result, causing inconvenience to shoppers waiting in line to checkout.

SUMMARY OF THE INVENTION

The present invention overcomes problems associated with using multiple reusable shopping bags by providing embodiments of a reusable shopping bag assembly including a group of reusable shopping bags in combination with a holding structure with a handle. An embodiment of the handle structure includes a flat handle frame with a pair of bag supporting sleeves projecting therefrom, the sleeves having sleeve bores extending therethrough and through the handle frame. A handle member extends from the handle frame. A plurality of reusable shopping bags are provided, each one having a pair of sleeve receiving apertures formed therethrough. The bags are positioned on the sleeves, and sleeve caps are positioned on the ends of the sleeves to retain the bags on the sleeves. The caps preferably include flexible cords or lanyards connected to the handle frame to prevent the caps from being separated from the frame and possibly lost.

The reusable shopping bag assembly forms a convenient unit to bring the reusable bags to a store where it may be placed in a shopping cart during shopping. The sleeves are spaced apart and have dimensions to allow the handle structure to be placed on a non-reusable bag support rack in front of the conventional plastic bags. At the checkout counter the customer hands the assembly to the cashier, who mounts the handle structure on the bag rack with rods or prongs thereof extending into the bores of the sleeves. The caps are then removed, and the reusable shopping bags are removed, one at a time, and filled with purchased items as they are scanned. When the purchased items have been checked out and packed in the bags, the handle structure, and any bags remaining thereon, are returned to the customer. When the items have been removed from the bags by the customer at home, the emptied reusable bags are replaced on the handle structure, ready for use on the next shopping trip. Alternatively, the store may provide a plurality of reusable shopping bag assemblies on a rack at a checkout counter which may be provided to a customer for use with current purchases and for re-use on future shopping trips.

Various objects and advantages of the present invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

DETAILED DESCRIPTION OF THE INVENTION

Figure 1:
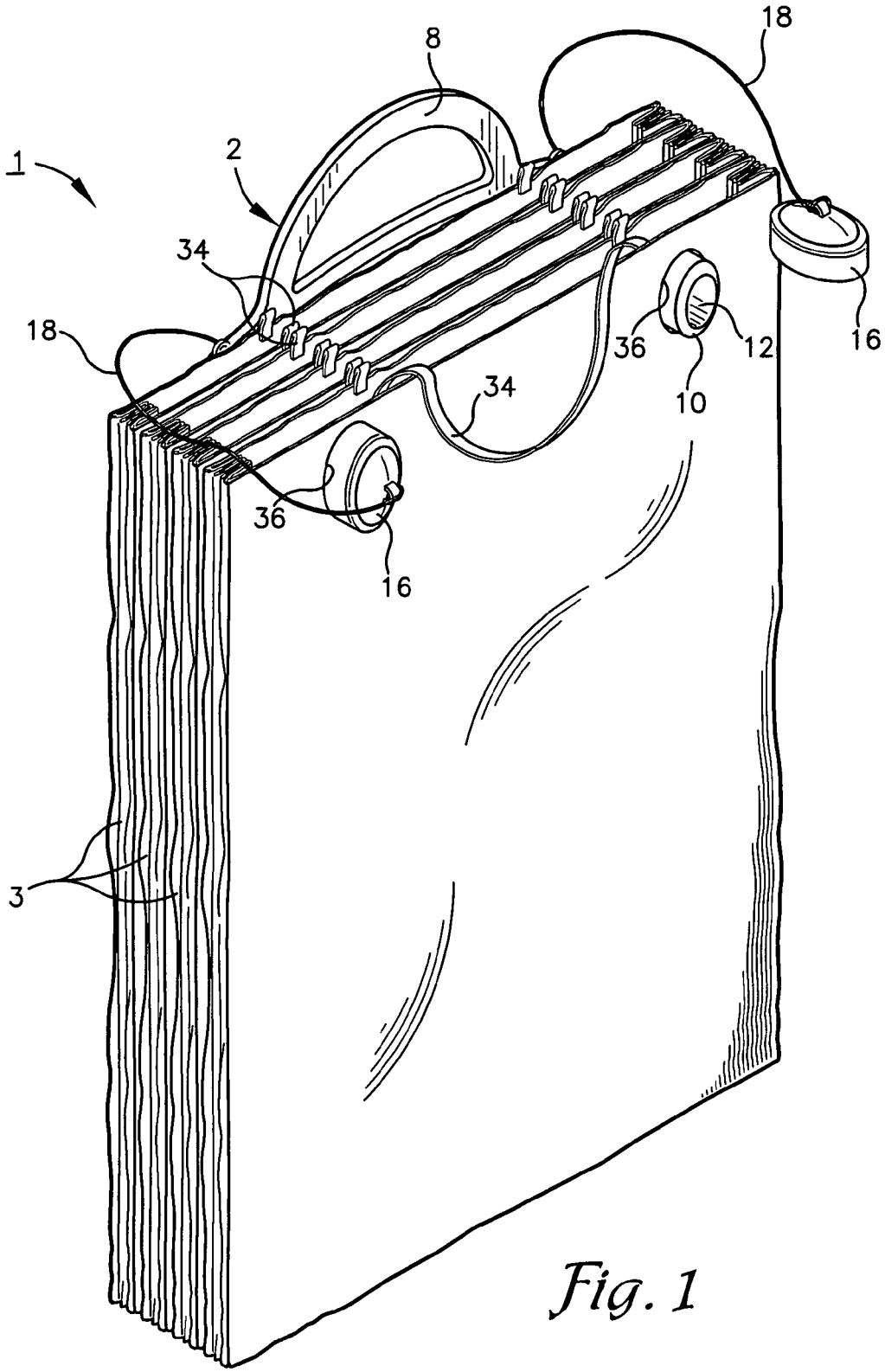
FIG. 1 is a perspective view of an embodiment of a reusable shopping bag assembly according to the present invention and including a handle structure with a plurality of reusable shopping bags supported thereon.

I. Introduction.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

II. Reusable Shopping Bag Assembly.

Referring to the drawings in more detail, the reference numeral 1 generally designates an embodiment of a reusable shopping bag assembly according to the present invention. The assembly 1 generally includes a handle structure 2 in combination with a plurality of reusable shopping bags 3 which are supported on the handle structure 2. The handle structure 2 cooperates with the plurality of reusable shopping bags 3 to increase the convenience of using multiple reusable shopping bags during shopping.

Figure 2:
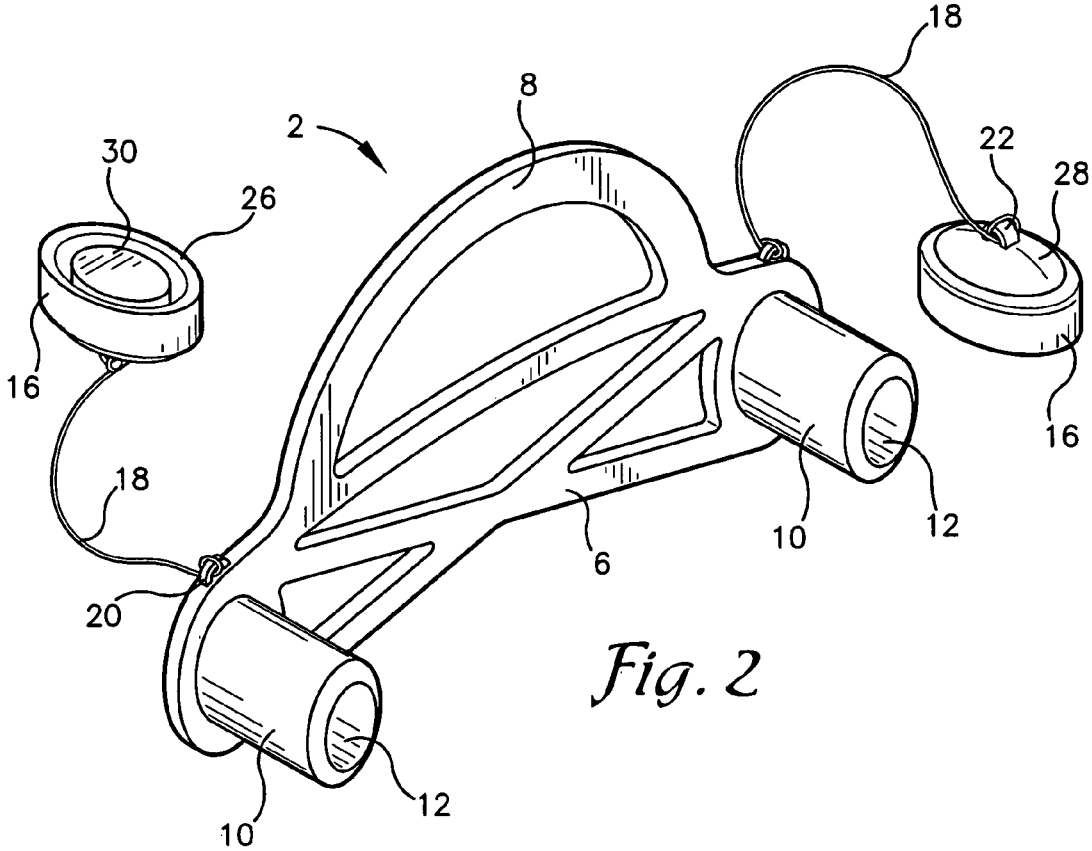
FIG. 2 is an enlarged perspective view of an embodiment of the handle structure forming a component of the assembly.
Figure 3:
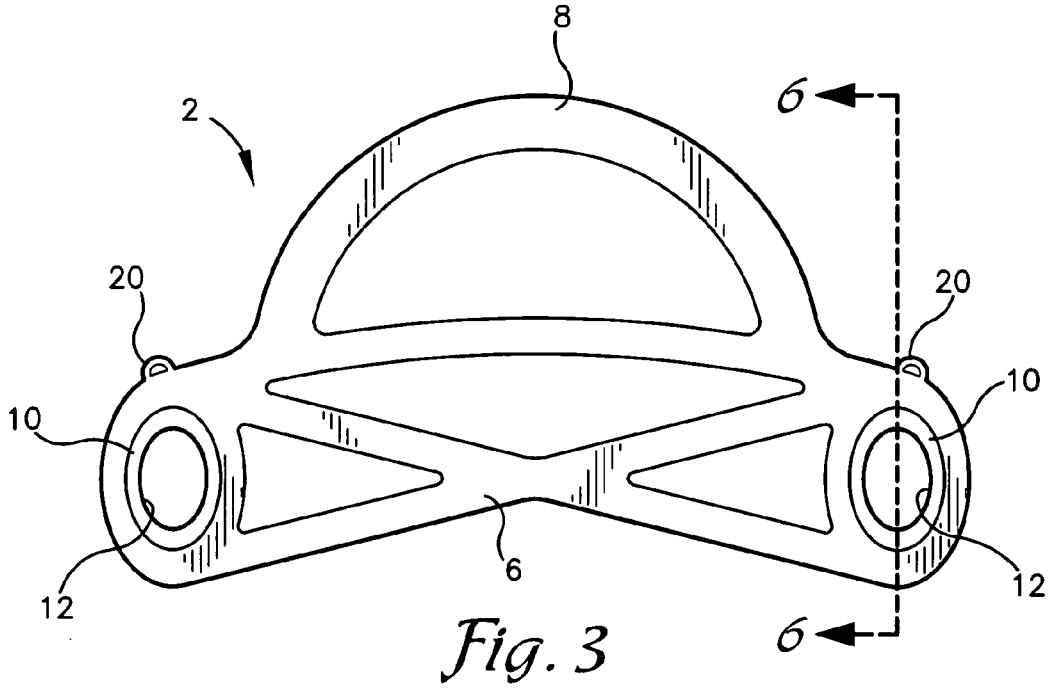
FIG. 3 is a front elevational view of the handle structure.
Figure 4:
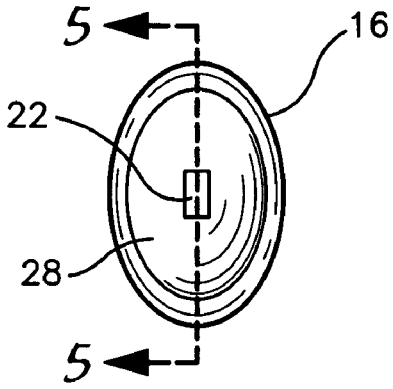
FIG. 4 is an enlarged front elevational view of a sleeve cap member of the handle structure.
Figure 6:
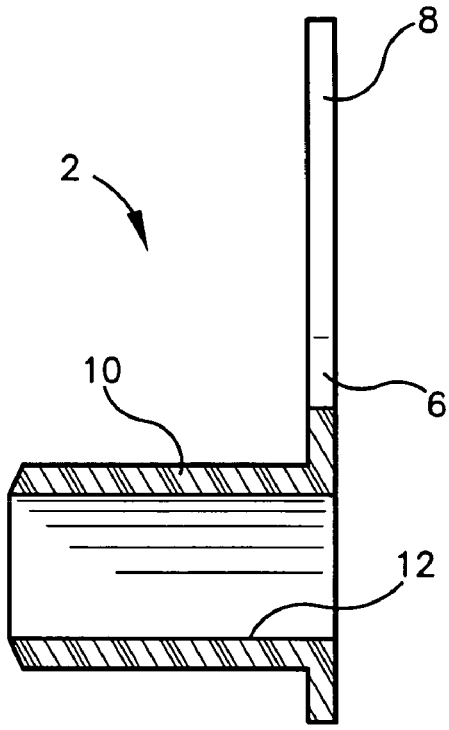
FIG. 6 is an enlarged vertical sectional view taken on line 6-6 of FIG. 3 and illustrates details of a reusable bag supporting sleeve of the handle structure including a sleeve bore extending through the sleeve and the handle frame.

Referring to FIGS. 2 and 3, the illustrated handle structure 2 includes a handle frame 6 which is generally flat in shape and has a handle member 8 looping across or extending from an upper side of the frame 6. The illustrated handle frame 6 has a truss-like construction, although it is foreseen that it could have other forms of construction such as a solid sheet or plate. Opposite ends of the frame 6 have a pair of bag supporting pegs or sleeves 10 projecting therefrom. The sleeves 10 have lengths adequate for supporting a plurality of the reusable shopping bags 3, for example four to six bags 3. As shown in FIG. 6, each of the illustrated sleeves 6 is preferably tubular and has a sleeve bore 12 which extends completely through the sleeve 6 and through the handle frame 6. The handle structure 2 can be formed of a suitable plastic, as by molding.

Figure 5:
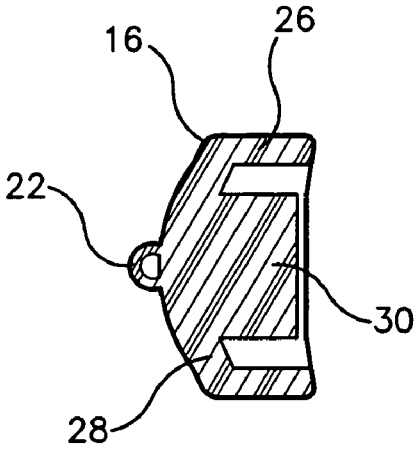
FIG. 5 is a vertical sectional view taken on line 5-5 of FIG. 4 and illustrates details of an embodiment of the sleeve cap.

As viewed particularly in FIG. 3, the illustrated sleeves 10 have an oval or elliptical cross sectional shape with a major axis thereof oriented vertically. It is foreseen that the sleeves 10 could have other cross sectional shapes, such as a circular or other rounded shape. The sleeves 10 preferably include a means for retaining bags 3 thereon until ready for use. FIGS. 1, 2, 4, and 5 show cap members 16 which are sized and shaped to be received on the ends of the sleeves 10. In order to prevent the caps 16 from being lost, the illustrated caps 16 are tied to the handle frame 6 by lanyards or cords 18. The lanyards 18 may be formed of a fiber based cord or string material, a monofilament polymer material, or the like. It is also foreseen that the lanyards 18 could be molded monolithically with the handle structure 2. The illustrated cords or lanyards 18 are shown tied to a frame loop 20 on the handle frame 6 and a cap loop 22 on the associated cap 16. Referring to FIG. 5, the illustrated cap 16 is formed by a collar section or collar 26 closed at one end by an end wall 28 and surrounding a central plug 30. When the cap 16 is placed on an end of a sleeve 10, frictional contact of the collar 26 with an outer surface of the sleeve 10 and of the plug 30 with the bore 12 of the sleeve cooperate to removably retain the cap 16 on the sleeve 10. It is foreseen that other means could be employed to retain the cap 16 on the sleeve 10 which are appropriate to the cross sectional shape of the cap 16 and sleeve 10, such as by threading or a bayonet type of engagement if the cap 16 and sleeve 10 were circular in cross section.

Referring to FIG. 1, the illustrated reusable shopping bags 3 are rectangular in shape which are closed at a lower end and open at a top end. The bags 3 may be provided with individual flexible bag handles or pairs of handles 34 to facilitate grasping the bags 3 when filled. The bags 3 are provided with spaced apart sleeve receiving apertures 36 which are sized, shaped, and spaced to receive the pair of the sleeves 10 therethrough. The bags 3 may be formed of a durable material such as a polymer film, a fiber reinforced film, a durable paper, a fiber-reinforced paper, a woven fabric, such as canvas, a synthetic fiber based fabric, or a blend of natural and synthetic fibers, or the like. When positioned on the handle structure 2, the bags 3 are in a flattened condition.

In use, a plurality of the reusable shopping bags 3 are loaded onto the handle structure 2 by passing the pairs of sleeves 10 through the bag apertures 36. The caps 16 are placed on the ends of the sleeves 10 to retain the bags 3 thereon. The reusable shopping bag assembly 1, thus formed, is taken to a store by the shopper and may be carried in a shopping cart (not shown) during shopping. When the customer is ready to checkout, the assembly 1 is given to the cashier or a bagger/sacker who mounts the assembly 1 on a bag rack or dispenser (not shown) holding a plurality of non-reusable plastic bags in front of such plastic bags, by extending prongs or bars supporting the plastic bags through the bores 12 of the sleeves 10. The caps 16 are removed, and the assembly 1 may be advanced farther back on the rack to allow the first reusable bag 3 to be pulled open to receive purchased items as they are scanned by the cashier. When the reusable bag 3 is filled, it may be given to the customer for placement in the shopping cart. The bag handle 34 provides for convenient grasping of the filled bag 3. The next reusable bag 3 may be pulled open and the procedure repeated until all the purchased items have been checked out. When the transaction is completed, the cashier returns the handle structure 2, with any remaining bags 3 thereon, to the customer. When the customer is at home and the bags 3 have been emptied, they are replaced on the handle structure 2 and the caps 16 put in place on the sleeves 10 to ready the assembly 1 for the next shopping trip.

The reusable shopping bag assemblies 1 can be provided to customers at low cost or for free by stores with dimensions to fit the single-use bag racks the store employs and with the store name printed on the bags 3, as a gesture to encourage shoppers to patronize their stores. Such assemblies I can be positioned on a rack at a checkout stand for use by a customer to pack current purchases and for re-use to pack purchases during future shopping trips.

It is to be understood that while certain forms of the present invention have been illustrated and described herein, it is not to be limited to the specific forms or arrangement of parts described and shown.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A handle structure for use with a plurality of shopping bags having first and second apertures therethrough, the handle structure comprising:

a handle member;

first and second pegs operatively coupled to the handle member for passing through the first and second apertures;

a first cap removably received on a distal end of the first peg to retain the plurality of bags on the first peg; and a second cap removably received on a distal end of the second peg to retain the plurality of bags on the second peg;

wherein the first peg includes a first bore extending at least partially therethrough, the first bore being accessible at a proximal end of the first peg and being sufficiently vacant when the first cap is received on the first peg for removably receiving a prong to support the first peg; and wherein the second peg includes a second bore extending at least partially therethrough, the second bore being accessible at a proximal end of the second peg and being sufficiently vacant when the second cap is received on the second peg for removably receiving another prong to support the second peg.

2. The handle structure of claim 1, wherein the first bore extends entirely through the first peg and the second bore extends entirely through the second peg.

3. The handle structure of claim 2, wherein the first and second caps are respectively retained on the distal ends of the first and second pegs by friction.

4. The handle structure of claim 3, further comprising a first lanyard member coupled to the first cap and a second lanyard member coupled to the second cap.

5. The handle structure of claim 4, wherein a unitary frame extends between the first and second pegs providing a fixed distance between the first and second pegs; and wherein the first and second lanyard members are coupled to the frame.

6. The handle structure of claim 2, wherein the first cap has a first plug configured to extend inside a portion of the first bore when the first cap is received on the first peg; and wherein the second cap has a second plug configured to extend inside a portion of the second bore when the second cap is received on the second peg.

7. The handle structure of claim 6, wherein a frame is coupled to the handle member and to the first and second pegs, the frame being adjacent the first peg proximal end and the second peg proximal end and providing a fixed distance between the first and second pegs.

8. The handle structure of claim 1, wherein the first and second pegs have a generally oval external perimeter.

9. The handle structure of claim 1, wherein the handle member includes a through hole for receiving at least a portion of a user's hand.

10. An apparatus for carrying a plurality of shopping bags having first and second apertures therethrough and supporting the bags on first and second rods, the apparatus comprising:

a first sleeve having distal and proximal ends and a first bore extending at least partially therethrough, the first bore being accessible at the proximal end of the first sleeve and being configured to receive the first rod, the first sleeve distal end being configured to pass through the first apertures;

a second sleeve having distal and proximal ends and a second bore extending at least partially therethrough, the second bore being accessible at the proximal end of the second sleeve and being configured to receive the second rod, the second sleeve distal end being configured to pass through the second apertures;

a handle member operatively coupled to the first and second sleeves;

a first cap removably coupled to the distal end of the first sleeve to retain the plurality of bags on the first sleeve, the first cap allowing the first rod to pass into and support the first sleeve when the first cap is coupled to the first sleeve distal end; and a second cap removably coupled to the distal end of the second sleeve to retain the plurality of bags on the second sleeve, the second cap allowing the second rod to pass into and support the second sleeve when the second cap is coupled to the second sleeve distal end.

11. The apparatus of claim 10, wherein the first bore extends entirely through the first sleeve and the second bore extends entirely through the second sleeve.

12. The apparatus of claim 11, wherein the first and second caps are respectively retained on the distal ends of the first and second sleeves by friction.

13. The apparatus of claim 12, further comprising a first lanyard member coupled to the first cap and a second lanyard member coupled to the second cap.

14. The apparatus of claim 13, wherein a unitary frame extends between the first and second sleeves providing a fixed distance between the first and second sleeves; and wherein the first and second lanyard members are coupled to the frame.

15. The apparatus of claim 11, wherein the first cap has a first plug configured to extend inside a portion of the first bore when the first cap is received on the first sleeve; and wherein the second cap has a second plug configured to extend inside a portion of the second bore when the second cap is received on the second sleeve.

16. The apparatus of claim 15, wherein a frame is coupled to the handle member and to the first and second sleeves, the frame being adjacent the first sleeve proximal end and the second sleeve proximal end and providing a fixed distance between the first and second sleeves.

17. The apparatus of claim 11, wherein the handle member includes a through hole for receiving at least a portion of a user's hand.

18. The apparatus of claim 11, wherein the first and second rods support a plurality of disposable shopping bags.

19. A reusable shopping bag assembly for use with first and second rods supporting a plurality of disposable shopping bags, the assembly comprising:

a plurality of reusable shopping bags each having first and second apertures therethrough;

a handle member;

first and second pegs operatively coupled to the handle member, the first peg passing through the first apertures, the second peg passing through the second apertures;

a first cap removably coupled to a distal end of the first peg to retain the plurality of bags on the first peg; and a second cap removably coupled to a distal end of the second peg to retain the plurality of bags on the second peg;

wherein the first peg includes a first bore extending at least partially therethrough, the first bore being accessible at a proximal end of the first peg and being sufficiently vacant when the first cap is coupled to the first peg for removably receiving the first rod to support the first peg; and wherein the second peg includes a second bore extending at least partially therethrough, the second bore being accessible at a proximal end of the second peg and being sufficiently vacant when the second cap is coupled to the second peg for removably receiving the second rod to support the second peg.

20. The assembly of claim 19, wherein:

the first bore extends entirely through the first peg;

the second bore extends entirely through the second peg;

a frame extends between the first and second pegs;

the frame provides a fixed distance between the first and second pegs; and the handle member includes a through hole for receiving at least a portion of a user's band.

* * * * *